US010435210B1

(12) United States Patent
Quinn

(10) Patent No.: US 10,435,210 B1
(45) Date of Patent: Oct. 8, 2019

(54) SCOOP DOCK AND USE METHODS

(71) Applicant: Plastek Industries, Inc., Erie, PA (US)

(72) Inventor: H Stephen Quinn, Eau Claire, WI (US)

(73) Assignee: Plastek Industries, Inc., Erie, PA (US)

( * ) Notice: Subject to any disclaimer, the term of this patent is extended or adjusted under 35 U.S.C. 154(b) by 175 days.

(21) Appl. No.: 15/625,236

(22) Filed: Jun. 16, 2017

Related U.S. Application Data

(60) Provisional application No. 62/352,232, filed on Jun. 20, 2016.

(51) Int. Cl.
*B65D 51/24* (2006.01)
*B65D 43/16* (2006.01)
*B65D 17/28* (2006.01)

(52) U.S. Cl.
CPC ..... *B65D 51/247* (2013.01); *B65D 17/4011* (2018.01); *B65D 43/163* (2013.01)

(58) Field of Classification Search
CPC . B65D 51/247; B65D 17/4011; B65D 43/163
USPC ..... 220/574.1
See application file for complete search history.

(56) References Cited

U.S. PATENT DOCUMENTS

2006/0000840 A1 1/2006 Kipperman et al.
2008/0156806 A1* 7/2008 Perry ..... B65D 25/2897 220/361
2014/0151389 A1* 6/2014 Melia ..... B65D 1/10 220/796
2016/0000270 A1 1/2016 Wiggins et al.

FOREIGN PATENT DOCUMENTS

WO WO-2011081677 A1 * 7/2011 ..... B65D 43/169

* cited by examiner

*Primary Examiner* — James N Smalley
(74) *Attorney, Agent, or Firm* — Bachman & LaPointe, P.C.

(57) ABSTRACT

In an assembly of a scoop and a closure, the scoop has a bowl and a handle. A closure has: a frame for mounting to a container body; and a cover hinged relative to the frame by a hinge. The scoop handle has at least one rib. The cover has an underside having a first projection and a second projection positioned to engage the scoop with the scoop in a docked position. The second projection is configured to capture the rib in the docked position.

21 Claims, 9 Drawing Sheets

SCOOP DOCK AND USE METHODS

CROSS-REFERENCE TO RELATED APPLICATION

Benefit is claimed of U.S. Patent Application No. 62/352,232, filed Jun. 20, 2016, and entitled "Scoop Dock and Use Methods", the disclosure of which is incorporated by reference herein in its entirety as if set forth at length.

BACKGROUND OF THE INVENTION

The invention relates to dispensing containers. More particularly, the invention relates to dispensing containers for powdered products.

Powdered product is sold in a variety of containers. One exemplary food product is infant formula. Other products include adult meal replacement mixes. Similar containers may be used for household or other chemicals such as powdered detergent, plant food, and so forth.

In recent decades, such products have been sold in containers along with a measuring scoop. In one basic example, the container is a metal can and the scoop is initially packed as loosely within the can. The can is typically sold along with a plastic snap-on cover which is used to close the can once the metal lid is removed (e.g., via can opener).

Such cans have largely been replaced by molded plastic jars with screw-on plastic closures (but also loosely containing a measuring scoop). More recently, dedicated containers have been proposed. In one example, US2006/000840 discloses a molded plastic container having a rounded rectangular planform. The lid includes features for mounting the scoop. The scoop has a round bowl of profile (e.g., radius selected to be complementary to a radius of corner junctions between the sidewall and the base of the container) so as to allow clean scooping of material from the bottom of the container. US2016/000270, the disclosure of which is incorporated by reference herein as if set forth at length, discloses a circular footprint/planform container with scoop dock features on the lid underside.

SUMMARY OF THE INVENTION

One aspect of the disclosure involves an assembly of a scoop and a closure. The scoop has a bowl and a handle. A closure has: a frame for mounting to a container body; and a cover hinged relative to the frame by a hinge. The scoop handle has at least one rib. The cover has an underside having a first projection and a second projection positioned to engage the scoop with the scoop in a docked position. The second projection is configured to capture the rib in the docked position.

Further embodiments may involve any physically possible combination of the claim elements or other disclosed features below.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements. Various of the drawings include artifacts of computer aided design (CAD) such as stitching lines which may be unseen in the actual container but help illustrate shape.

DETAILED DESCRIPTION

Figure 1:
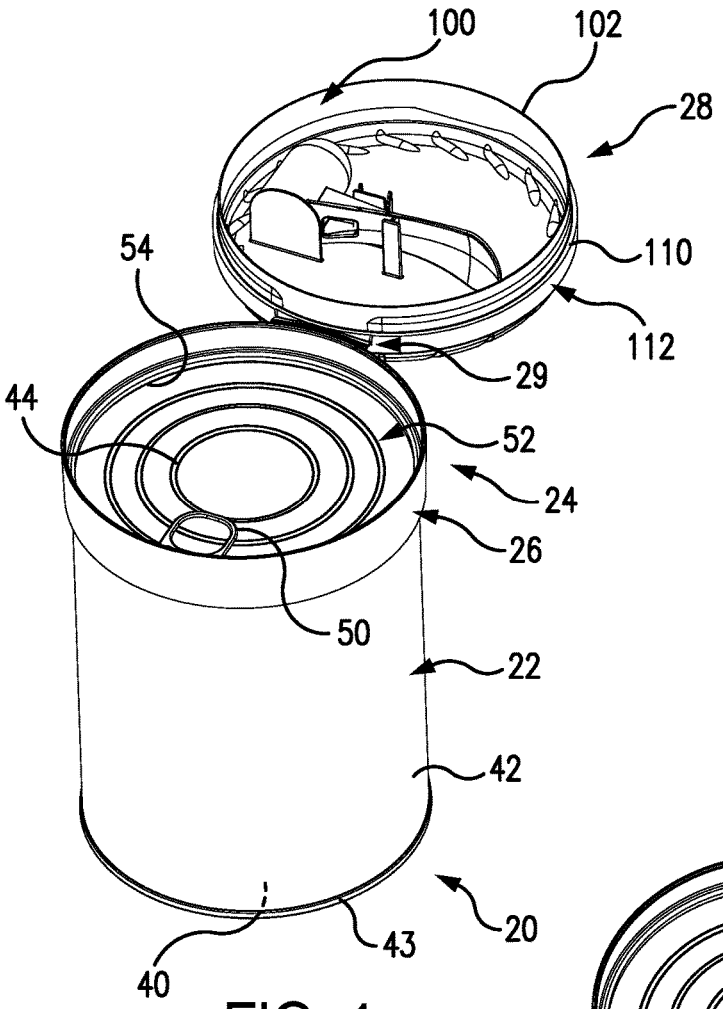
FIG. 1 is a first view of a container in a cover-opened, scoop-docked, condition prior to can-opening.

FIG. 1 shows an exemplary container assembly 20 having a body 22 and a closure 24. An exemplary body may comprise a can. One group of cans are essentially metallic (e.g., ignoring coatings). Another group of cans are metal-paper hybrids (e.g., having a metal bottom, a metal top, and a cardboard sidewall (optionally metallic lined)). Initially, the can may be sealed such as by being a sheetmetal top requiring a can opener to open, or by a sheetmetal top having a pull tab to tear off a portion, or by having a peel-off or tear-off foil seal or the like. Other bodies are molded plastic. An exemplary molded plastic body is an extrusion blow-molded multi-layered tub for beneficial moisture and light blocking.

The closure 24 comprises a base or frame 26 mounted to the can and a lid/cover 28 (an outer lid/cover as is discussed below) connected to the frame by a living hinge 29. The exemplary frame, cover and hinge are unitarily-molded as a single piece (e.g., injection molded polypropylene or other plastic). A two-shot molding process allows the frame and cover to be different colors from each other, if desired. A latch (not shown) may be formed on the lid and frame (e.g., including a latch feature of the frame and a latch feature) of the cover.

Figure 8:
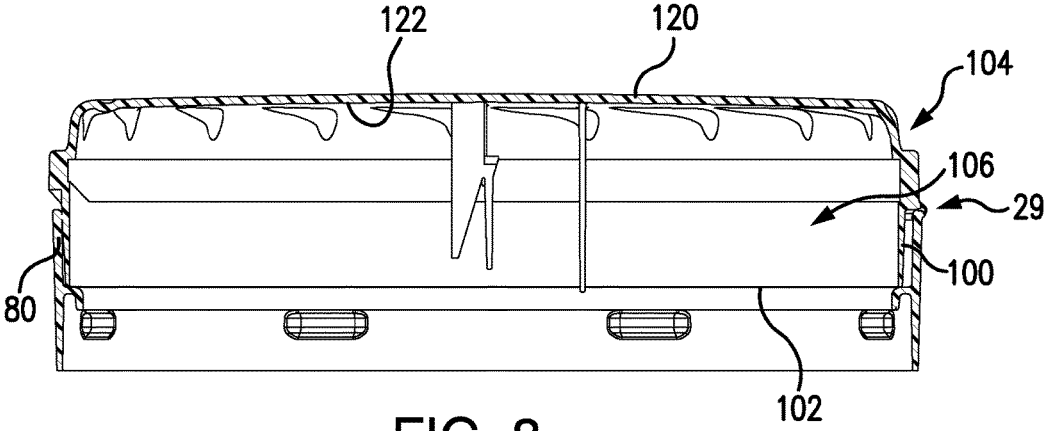
FIG. 8 is a vertical sectional view of the cover of FIG. 7 taken along line 8-8.

The exemplary body has a base formed by a metallic bottom 40, and a sidewall 42 extending upward from the base to a top 44. The exemplary bottom and top include respective perimeter crimps 43, 45 (FIG. 8) grasping the adjacent edge of the sidewall. The top includes a pull tab 50 for removing a central portion 52 of the top bounded by a reduced thickness area 54 (e.g., a scored perimeter) leaving the top crimp 45.

The frame planform is complementary to the planform of the body to which it mates (e.g., the can top crimp 45 in the example). To establish a frame of reference, the hinge 29 is formed at a rear of the frame. The exemplary frame has a downwardly open channel cross-section for receiving an upper portion of the container (e.g., receiving the top crimp 45).

Figure 9:
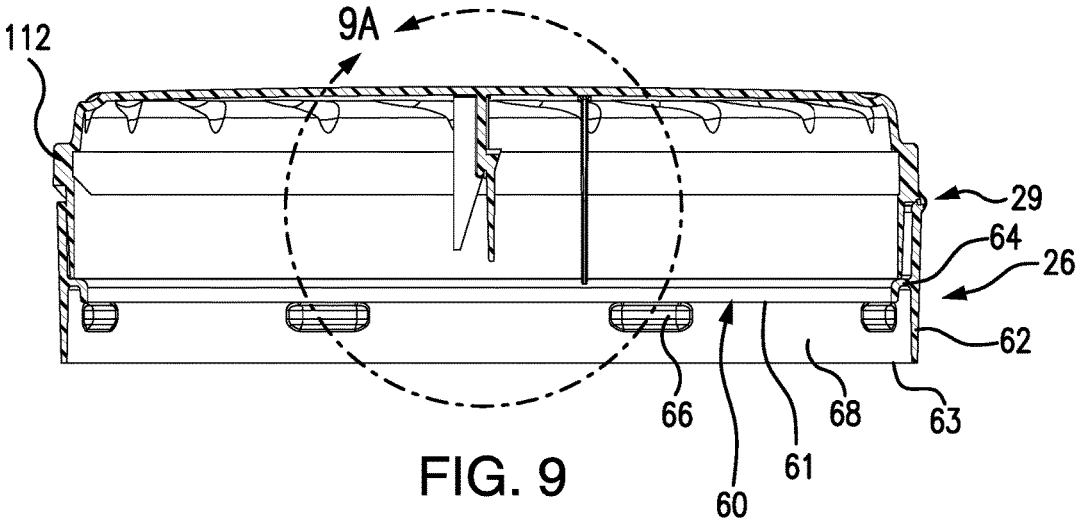
FIG. 9 is a vertical sectional view of the cover of FIG. 7 taken along line 9-9.

The frame 26 (FIG. 9) has an inner sidewall 60 having a lower rim 61, an outer sidewall 62 having a lower rim 63, and an upper channel base or annular web 64 joining the inner and outer sidewalls (e.g., at an upper edge of one of the two).

Figure 12:
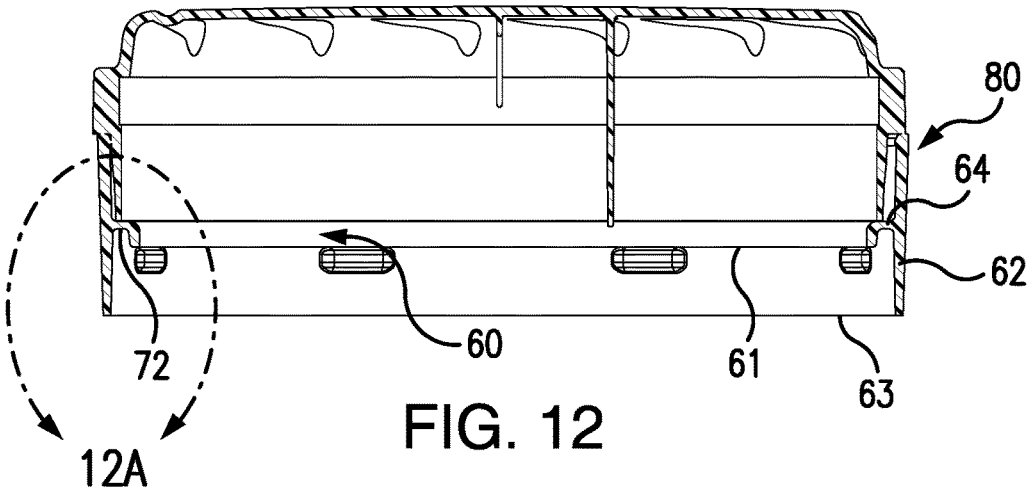
FIG. 12 is a vertical sectional view of the cover of FIG. 7 taken along line 12-12.
Figure 12A:
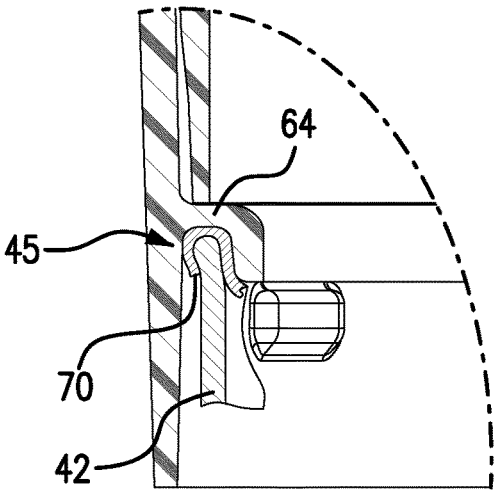
FIG. 12A is an enlarged view of a dock portion of the cover of FIG. 12.

The frame has features for securing the frame to the body. With the exemplary channel-like section, these features may comprise radially-inwardly protruding projections 66 on the inboard or inner diameter (ID) surface 68 of the outer sidewall. In the installed condition, such projections may be captured by an underside 70 (FIG. 12A) of the top crimp (and vice versa, capturing the top crimp against the underside 72 of the web 64).

Figure 2:
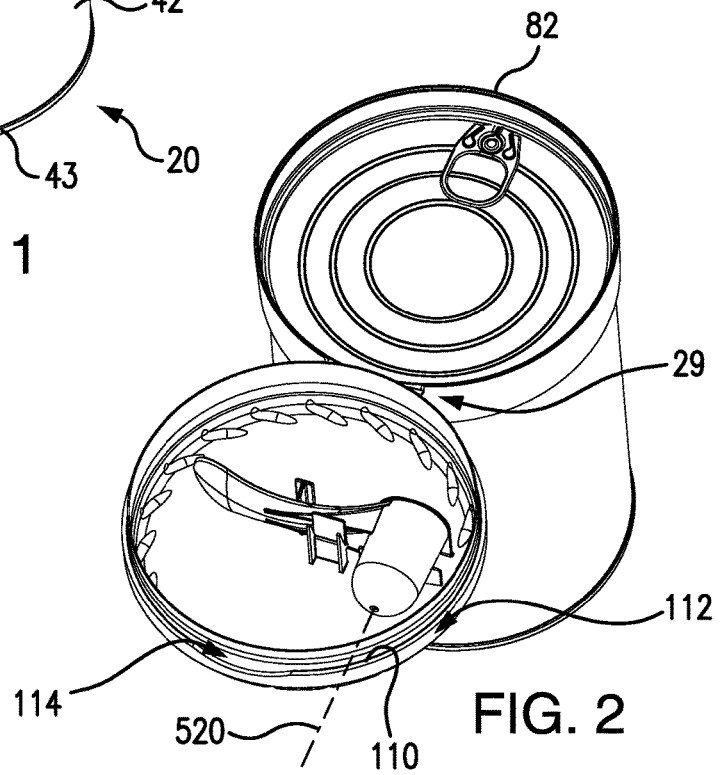
FIG. 2 is a second view of the container in the cover-opened, scoop-docked, condition prior to can-opening.

The cover 28 (FIG. 1) has a sidewall 100 extending upward from a lower rim 102 (FIG. 8) to a shoulder 104. In the exemplary closure, a lower portion 106 of the cover sidewall 100 nests within an upper portion 80 of the frame (e.g., of the frame outer sidewall 62) in the cover-closed condition. In the exemplary configuration, the upper portion 80 (thus the outer sidewall) has an upper rim surface 82 (FIG. 2). In the cover-closed condition, the upper rim surface 82 abuts a complementary surface of the cover 28. An exemplary complementary surface is an underside 110 of a shoulder or flange (e.g., a radially outwardly protruding flange 112). Sheet 1 shows a thumb notch recess 114 in the surface 110 diametrically opposite the hinge 29. This allows ease of opening of the container. The diametric tolerance of the upper sidewall lower portion 106 (FIG. 8) and frame sidewall upper portion 80 may be effective to provide a detent action detenting the cover-closed condition. Other detenting or latching features may also be provided. A top web 120 spans the shoulder 104 and has an underside 122.

Figure 5:
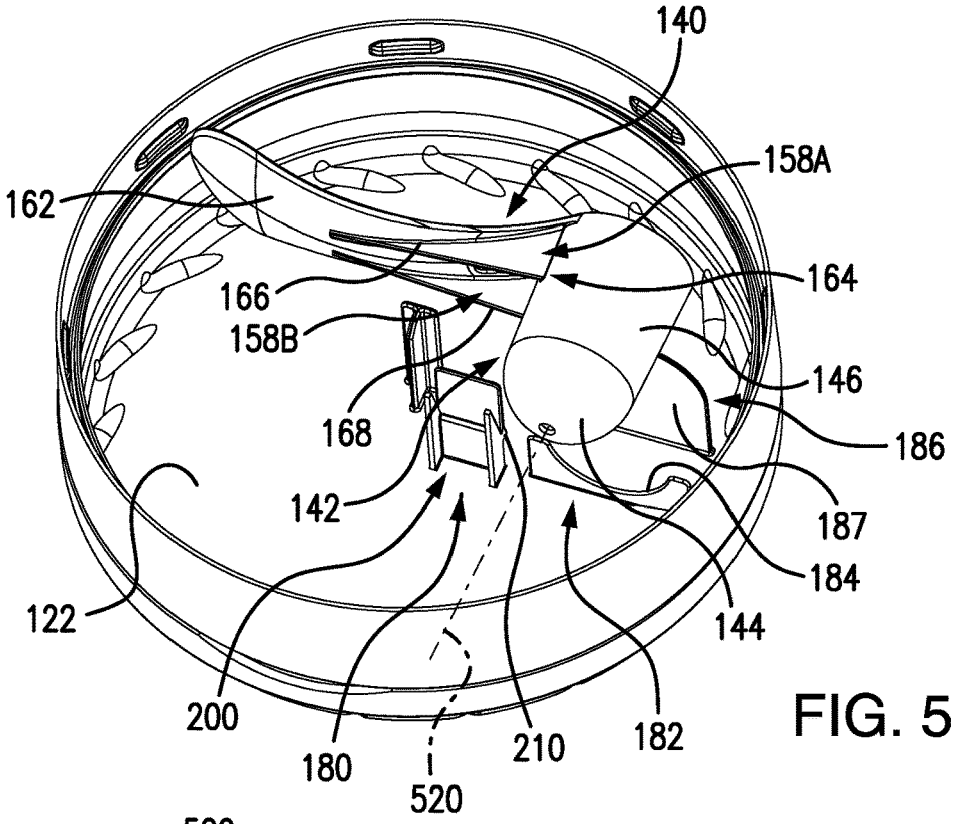
FIG. 5 is a first view of the container cover in a cover-closed, scoop-undocked, condition with scoop exploded partially away.
Figure 6:
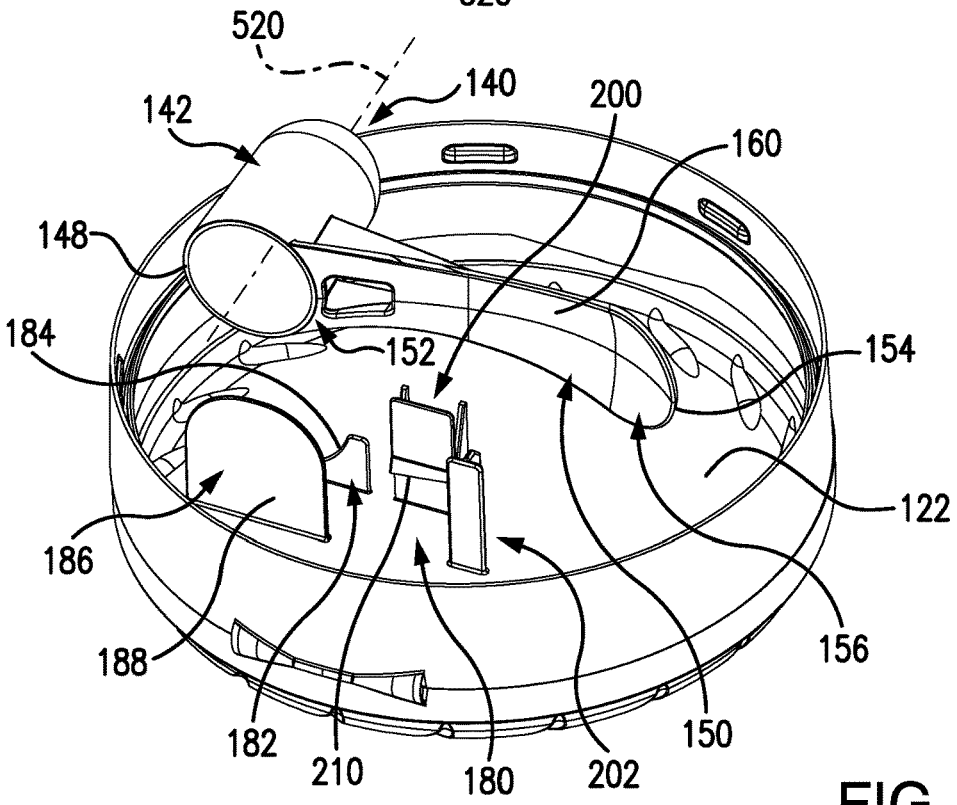
FIG. 6 is a second view of the container cover in a cover-closed, scoop-undocked, condition with scoop exploded partially away.

FIGS. 5 and 6 further show a scoop 140 (e.g., a separate plastic injection molding) having a bowl 142 which includes a bottom or base 144 and a sidewall 146 extending from the base 144 to a rim 148 (FIG. 6) of the bowl. A handle 150 extends from a root at a proximal end 152 at the bowl to a distal handle end 154. The handle includes a main portion 156, a pair of reinforcing ribs or buttresses 158A, 158B. In the exemplary embodiment, the main portion 156 extends from the proximal end adjacent the rim 148 to the distal handle end 154. The main portion has an upper surface 160 and a lower surface 162. The exemplary upper surface is generally proximally-to-distally concave and the lower surface is generally convex for ergonomics. The exemplary ribs 158A and 158B each have a proximal junction 164 with the scoop bowl sidewall 46 and distal junction 166 with the handle main portion 156 underside 162. These two junctions may merge at the proximal end of the handle main portion underside. This leaves the exemplary ribs with an exposed lower edge 168.

FIGS. 5 and 6 further show a scoop dock 180 for holding the scoop in the docked condition. The dock is formed by a plurality of projections depending from the underside of the cover (the underside 122 of the top web 120). The exemplary projections include a cradling projection (cradle) 182 formed as a thin web having a concave lower end or rim 184 of shape complementary to the convexity of the scoop bowl sidewall 146 to cradle the scoop bowl sidewall in the docked condition to resist horizontal translation generally transverse to the axis 520 of the scoop bowl in the docked condition. The projections further include a fin-like projection 186 having a first face 187 and an opposite second face 188. The first face 187 faces the cradle 182 and may be generally parallel to the cradle. The projection 186 is dimensioned to face the scoop bowl rim 148 and potentially directly contact it in the docked condition. This prevents shifting of the scoop essentially parallel to its axis in a direction toward the projection 186 (upward in the scoop frame of reference while still horizontal in the upright container frame of reference). The exemplary configuration provides two further projections of which a projection 200 is a latching projection and a projection 202 helps position the scoop along with the other projections. In the exemplary embodiment, the projection 202 is generally to the same side of the scoop as is the projection 186 (i.e., upward in the scoop frame of reference). The exemplary projection 202 has a T-like transverse cross-section for strength with the leg of the T extending toward the handle and contacting or closely blocking the surface 160 with the scoop in the docked condition.

Figure 3:
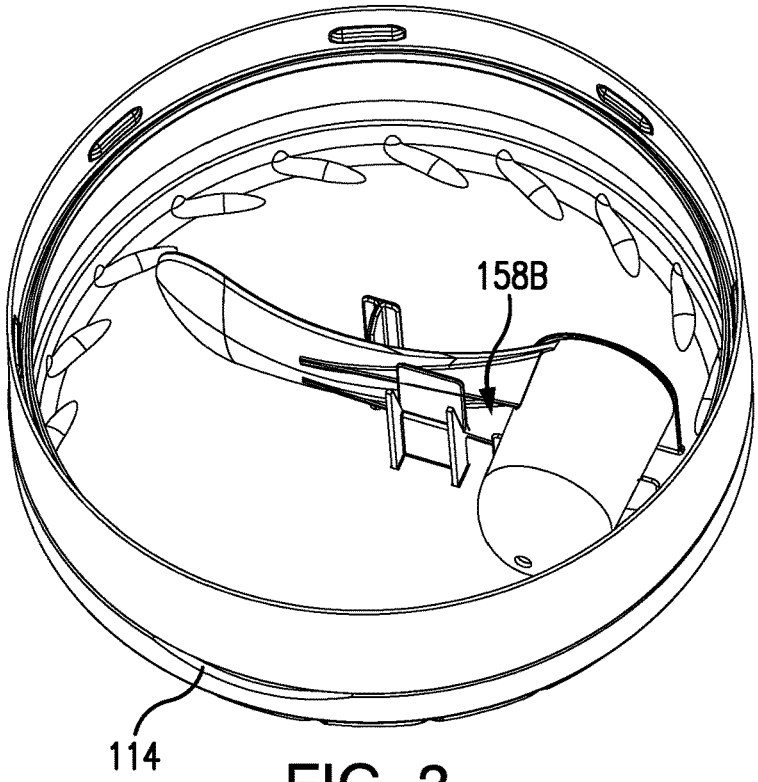
FIG. 3 is a first view of the container cover in a cover-closed, scoop-docked, condition.
Figure 4:
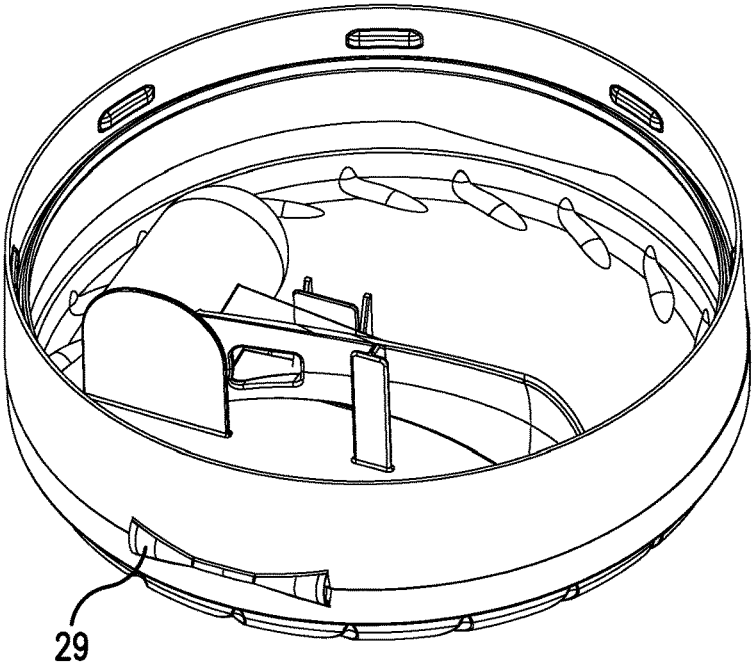
FIG. 4 is a second view of the container cover in the cover-closed, scoop-docked, condition.

The projection 200 is to an opposite side of the handle from the projections 186 and 202. The projection 200 serves to hold the scoop vertically in its docked condition. To do this, the projection 200 has a surface 210 positioned to capture a portion of the handle. FIGS. 5 and 6 show this surface 210 and FIG. 3 shows this surface 210 contacting an inboard face or side of the rib 158B with the scoop docked.

Figure 7:
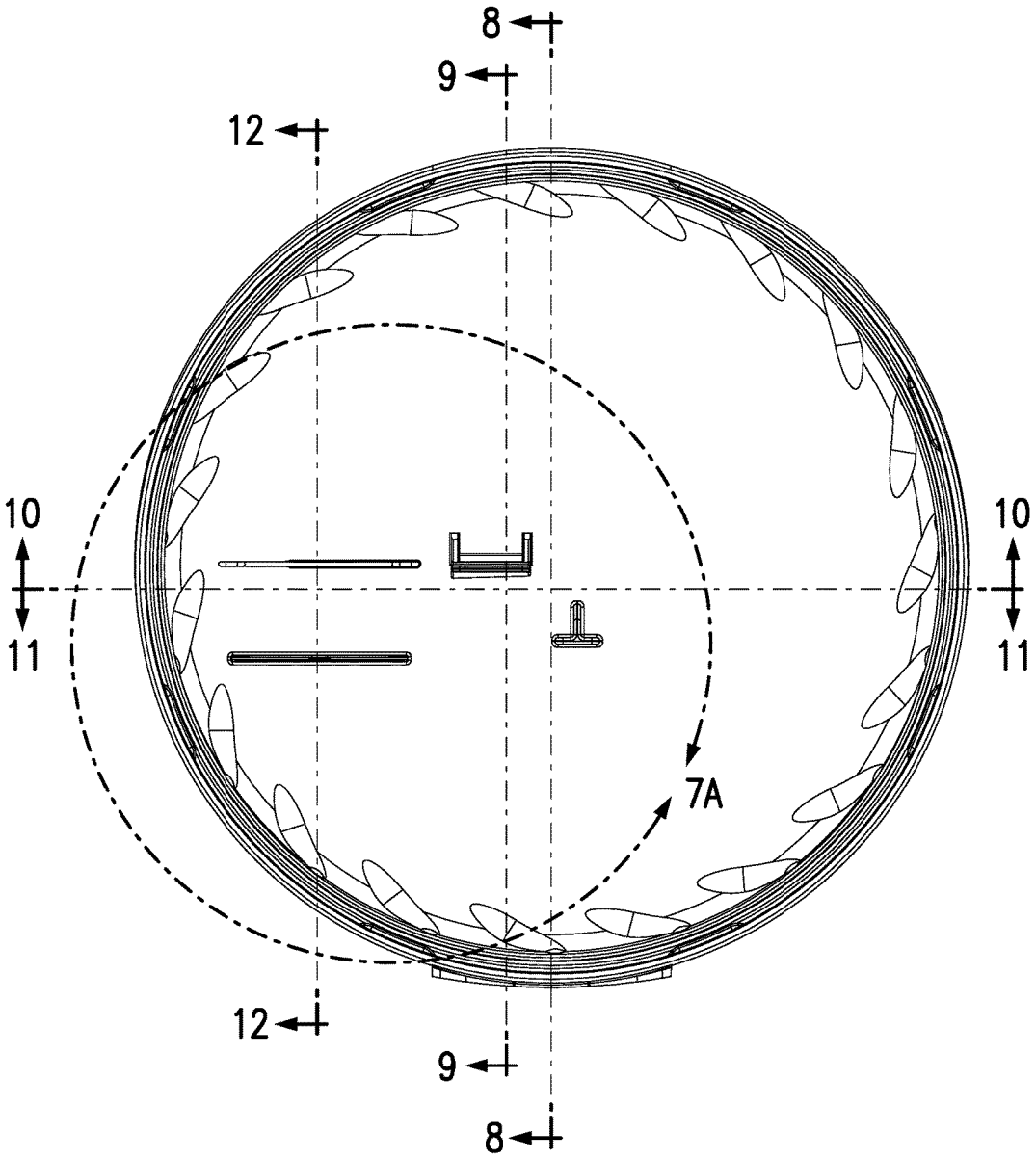
FIG. 7 is a bottom view of the container cover in the cover-closed, scoop-undocked, condition.
Figure 7A:
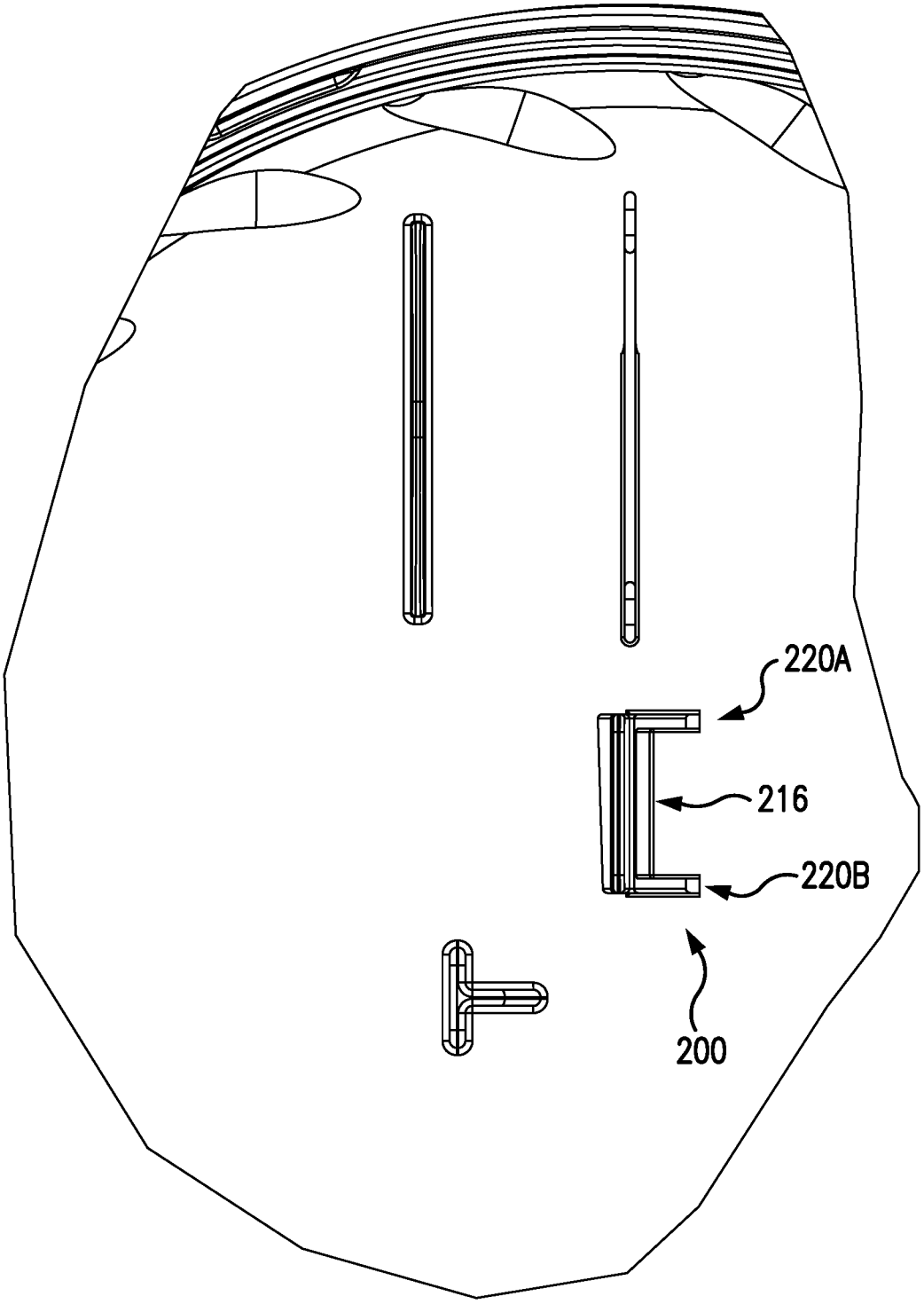
FIG. 7A is an enlarged view of a dock portion of the cover of FIG. 7.
Figure 9A:
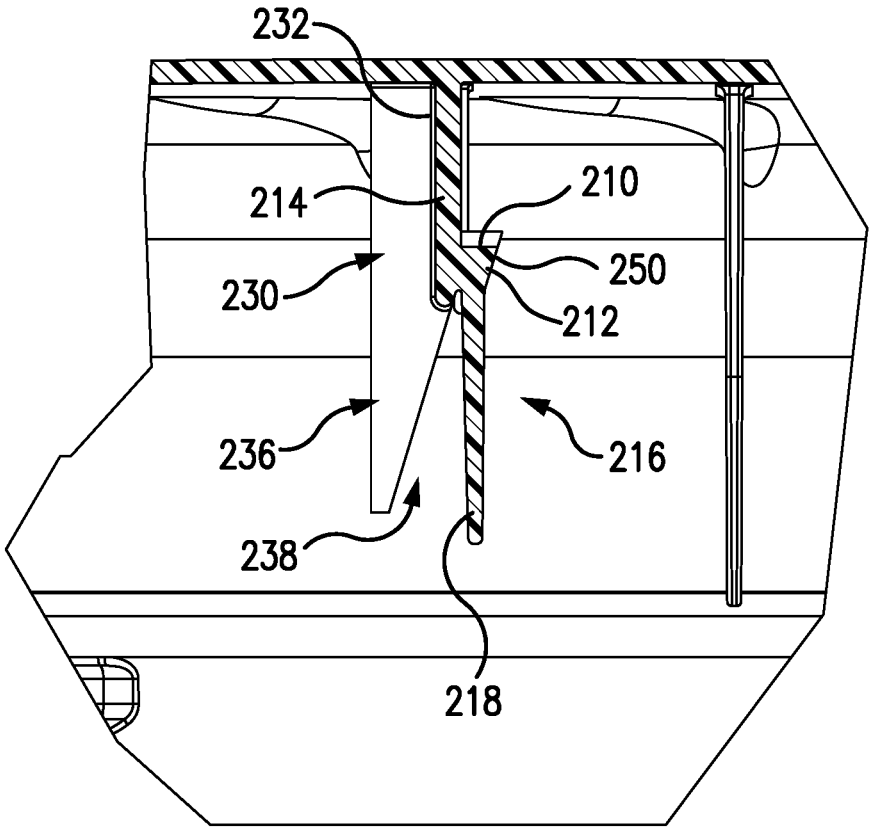
FIG. 9A is an enlarged view of a dock portion of the cover of FIG. 9.
Figure 10:
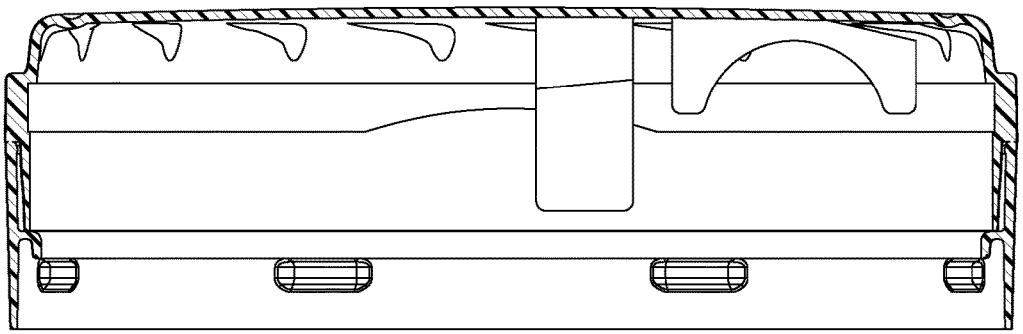
FIG. 10 is a vertical sectional view of the cover of FIG. 7 taken along line 10-10.
Figure 11:
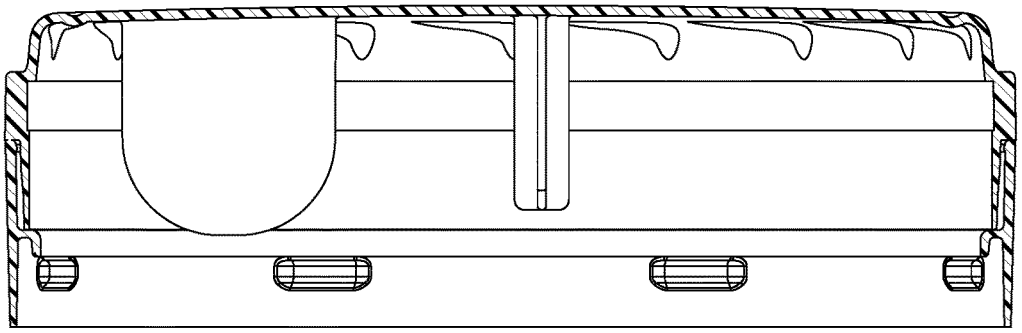
FIG. 11 is a vertical sectional view of the cover of FIG. 7 taken along line 11-11.

FIG. 9A shows the surface 210. The surface 210 is underside of a shoulder portion 212 separating a proximal portion 214 of a web 216 of the projection 200 from a distal portion 218. The web forms a main wall of the projection 200. At opposite ends, the projection includes respective end walls 220A and 220B (FIG. 7A). The end walls each have a proximal portion 230 (FIG. 9A) having a junction 232 with the web proximal portion 214. The end walls also have a distal portion 236 angled away from and separated from the main wall distal portion 218 by an associated gap 238. The distal portions 236 may serve as a backup allowing a user to manually flex the distal portion 218 toward the distal portions 236 with closing of the gaps 238 and resulting contact acting as a stop on over-bending/over-flexing. The shoulder 212 is also seen as having an angled camming surface 250. As the scoop is shifted in toward the docked condition, the rib 158B will contact the surface 250 and cause a wedging pressure/force to exist between the projection 200 on the one hand and the projections 186 and 202 on the other hand. Flexing of these projections will allow the rib to move down the surface 250 and snap under the shoulder 212 to be captured by the underside 210. Thus, the exemplary docked condition is a latched condition. With the cover then closed, the scoop will not fall into the container.

The release the scoop, the user may flex the distal portion 218 of the main wall 216 (e.g., via a thumb actuation). This may be effective to shift the shoulder 212 underside 210 out of engagement with the rib allowing the scoop to pop slightly away from the underside. Release of the flexing pressure will allow the scoop to ride up along the surface 250 to eject from the docked condition.

The can or other container may be manufactured/filled by conventional processes.

The exemplary closure as shown consists of two molded pieces plastic. The first piece forms the frame and cover or lid (outer cover or lid) including their living hinge and the latching features. The second piece forms the scoop.

In one exemplary process, with the first piece in its as-molded (open) condition, the second piece is installed by a translation to dock the scoop.

The cover may then be closed and detented or latched in that condition.

Accordingly, this process leaves the scoop assembled to the closure ready for installation to the container body. Alternatively, the cover may first be closed from the as-molded (open) condition and then the scoop attached.

An exemplary securing to the container body comprises downwardly pressing the closure onto the body so that the projections 66 pass over and ultimately capture the top crimp. An overwrap and other tamper-evident feature may then be applied. Additionally, the closure itself may have been manufactured with one or more tamper-evident features (not shown).

In use, the user may remove any shrink seal, break any tamper-evident feature, and then unlatch the latch (if any) and rotate the cover to an open condition (e.g., to or toward the as-molded condition). The user may then remove the scoop.

At first use, the user may open the can pull tab or remove a safety foil or the like. The user may then use the scoop to scoop the contents. The scoop may then be reinstalled to the dock. The cover may then be closed.

One or more embodiments of the present invention have been described. Nevertheless, it will be understood that various modifications may be made without departing from the spirit and scope of the invention. For example, when implemented in the modification of an existing container configuration, details of the existing configuration or its use may influence details of any particular implementation. Accordingly, other embodiments are within the scope of the following claims.

What is claimed is:

1. A closure and scoop assembly comprising:
- a scoop comprising a bowl and a handle, the handle including a rib; and
- a closure comprising:
  - a frame for mounting to a container body; and
  - a cover hinged relative to the frame by a hinge and having:
    - an underside;
    - a first projection positioned to engage the scoop in a docked condition; and
    - a second projection positioned to engage the scoop handle in the docked condition and having a surface positioned in a locking condition to retain the scoop against the underside in the docked condition, the second projection flexible to an unlocking condition allowing release of the scoop, wherein:
- the second projection has:
  - a pair of end walls; and
  - a main wall, wherein:
    - said surface is along a face of the main wall;
    - said end walls protrude opposite said face; and
    - a distal portion of said main wall protrudes distally of the surface to allow user thumb access.

2. The assembly of claim 1 wherein:
- the cover underside has a concave ended projection accommodating a convex surface of the scoop bowl in the docked condition.

3. The assembly of claim 1 wherein:
- the cover underside has a third projection positioned to at least partially block an opening of the scoop bowl in the docked condition.

4. The assembly of claim 1 wherein:
- the first projection is positioned to contact the handle in the docked condition; and
- the second projection is positioned to contact the handle proximally of the first projection in the docked condition.

5. The assembly of claim 1 wherein:
- the first projection has a T-shaped cross-section.

6. The assembly of claim 5 wherein:
- the first projection has:
  - a leg of the T-shaped cross-section positioned to contact the handle in the docked condition and extending to the cover underside.

7. The assembly of claim 1 wherein:
- said surface of the second projection is an underside of a shoulder between a proximal portion of the main wall and said distal portion of the main wall.

8. The assembly of claim 1 wherein:
- said surface of the second projection is an underside of a shoulder between a proximal portion of the second projection and a distal portion of second projection.

9. The assembly of claim 1 wherein:
- the hinge is a living hinge.

10. A container comprising the assembly of claim 1 and further comprising:
- a container body to which the frame is mated; and
- product contained within the container body.

11. The container of claim 10 wherein:
- the container body is a can.

12. A method for using the container of claim 10, the method comprising:
- shifting the cover from a closed condition to an open condition;
- removing the scoop from the scoop dock; and
- scooping the product from the container body.

13. The method of claim 12 wherein:
- the removing of the scoop comprises pressing the second projection by a user's finger.

14. The method of claim 13 wherein:
- the pressing unlatches the scoop.

15. The method of claim 14 further comprising:
- reinstalling the scoop to the scoop dock; and
- returning the cover to its closed condition.

16. The method of claim 15 wherein:
- the reinstalling of the scoop comprises a camming interaction with the second projection.

17. A method for using a container, the container comprising:
- a container body;
- product contained within the container body; and
- a closure and scoop assembly comprising:
  - a scoop comprising a bowl and a handle, the handle including a rib; and
  - a closure comprising:
    - a frame mounted to the container body; and
    - a cover hinged relative to the frame by a hinge and having:
      - an underside;
      - a first projection positioned to engage the scoop in a docked condition; and
      - a second projection positioned to engage the scoop handle in the docked condition and having a surface positioned in a locking condition to retain the scoop against the underside in the docked condition, the second projection flexible to an unlocking condition allowing release of the scoop, the method comprising:

shifting the cover from a closed condition to an open condition;

removing the scoop from the scoop dock, the removing of the scoop comprising pressing the second projection by a user's finger; and scooping the product from the container body.

18. The method of claim 17 wherein:

the pressing unlatches the scoop.

19. The method of claim 18 further comprising:

reinstalling the scoop to the scoop dock; and returning the cover to its closed condition.

20. The method of claim 19 wherein:

the reinstalling of the scoop comprises a camming interaction with the second projection.

21. A closure and scoop assembly comprising:

a scoop comprising a bowl and a handle, the handle including a rib; and a closure comprising:

a frame for mounting to a container body; and a cover hinged relative to the frame by a hinge and having:

an underside;

a first projection positioned to engage the scoop in a docked condition; and a second projection positioned to engage the scoop handle in the docked condition and having a surface positioned in a locking condition to retain the scoop against the underside in the docked condition, the second projection flexible to an unlocking condition allowing release of the scoop, wherein:

the second projection has:

a pair of end walls; and a main wall;

a proximal portion of the main wall merges with respective proximal portions of the end walls; and a distal portion of the main wall is separated by respective gaps from distal portions of the end walls.

* * * * *